US005224451A

United States Patent [19]

Straubel

[11] Patent Number: 5,224,451

[45] Date of Patent: Jul. 6, 1993

[54] SYSTEM FOR CONTROLLING AN INTERNAL COMBUSTION ENGINE

[75] Inventor: Max Straubel, Stuttgart, Fed. Rep. of Germany

[73] Assignee: Robert Bosch GmbH, Stuttgart, Fed. Rep. of Germany

[21] Appl. No.: 872,089

[22] Filed: Apr. 22, 1992

[30] Foreign Application Priority Data

Jun. 6, 1991 [DE] Fed. Rep. of Germany ..... 4118558

[51] Int. Cl.[5] ..... F02D 41/22; F02D 41/38; F02D 41/04

[52] U.S. Cl. ..... 123/359; 123/479

[58] Field of Search ..... 123/357, 358, 359, 479, 123/198 D

[56] References Cited

U.S. PATENT DOCUMENTS 3,699,935 10/1972 Adler et al. ..... 123/359 X
3,834,361 9/1974 Keely ..... 123/479
4,223,654 9/1980 Wessel et al. ..... 123/358
4,425,889 1/1984 Hachitani et al. ..... 123/479 X
4,428,346 1/1984 Hoshi ..... 123/479 X
4,791,900 12/1988 Buck et al. ..... 123/359

*Primary Examiner*—Tony M. Argenbright
*Attorney, Agent, or Firm*—Kenyon & Kenyon

[57] ABSTRACT

A system for controlling an internal combustion engine of a motor vehicle, and, in particular, a self-ignitible internal combustion engine, that produces a speed signal, as well as a signal associated with the driver of the motor vehicle, such as a gas pedal position signal. A control unit supplies an actuating signal to a power-regulating controlling unit that controls the fuel injection quantity for the engine under both normal and emergency conditions. The actuating signal is based on the signal associated with the driver and inversely proportional to the speed signal.

15 Claims, 2 Drawing Sheets

SYSTEM FOR CONTROLLING AN INTERNAL COMBUSTION ENGINE

FIELD OF THE INVENTION

The present invention relates to a system for controlling an internal combustion engine, and, in particular, relates to a control system for maintaining smooth operation under emergency conditions.

BACKGROUND OF THE INVENTION

German Published Patent Application No. 35 31 198 discloses a system for controlling an internal combustion engine. It describes a method and a device for controlling a self-ignitible internal combustion engine with a fuel pump, a speed sensor, and a gas-pedal position sensor. A controlling unit, which determines the quantity of fuel to be injected, is triggered dependent upon various signals. The described system comprises a very complex monitoring system. Upon recognition of an emergency situation, the injected fuel quantity is reduced to a specified value. This complex monitoring system makes it possible to guarantee that, even if some of its components fail, no critical operating states, which would destroy the internal combustion engine, are attained. However, this system has the disadvantage that only a very limited operation is possible when an emergency situation is recognized. All that is guaranteed is that the driver is able to drive to the nearest service station.

Problems also arise in such a system because errors also occur in the monitoring system. As a result, the danger of switching to emergency operation on a very frequent basis exists, which means that only a very limited driving operation remains possible.

The object of the present invention is to improve the availability of a system for controlling an internal combustion engine to maintain smooth operation under emergency conditions, even if various sensors or the control unit should fail.

SUMMARY OF THE INVENTION

With the control system according to the present invention, it is possible to continue to operate the internal combustion engine even if various sensors or the control unit fail. Since the actuating signal for triggering the controlling unit that controls the fuel injection quantity is inversely proportional to the speed signal, a substitute actuating signal can be made available very easily based on a substitute speed signal. By evaluating the voltage across a terminal of a generator, a very simple substitute speed signal can be extracted. This signal is also available if the normal speed sensor fails. This control system guarantees that the internal combustion engine can be operated for as long as the controlling unit that controls the fuel injection quantity, the gas-pedal position sensor, and the generator are operative. Since good driving performance results from this system, one can accept the fact that the switch-over to the emergency system is made more often for the sake of safety. The usual safety and emergency driving plans can be reduced, so that considerable cost savings result. At the same time, the safety and the availability of the entire system rises.

DETAILED DESCRIPTION OF THE INVENTION

Figure 1:
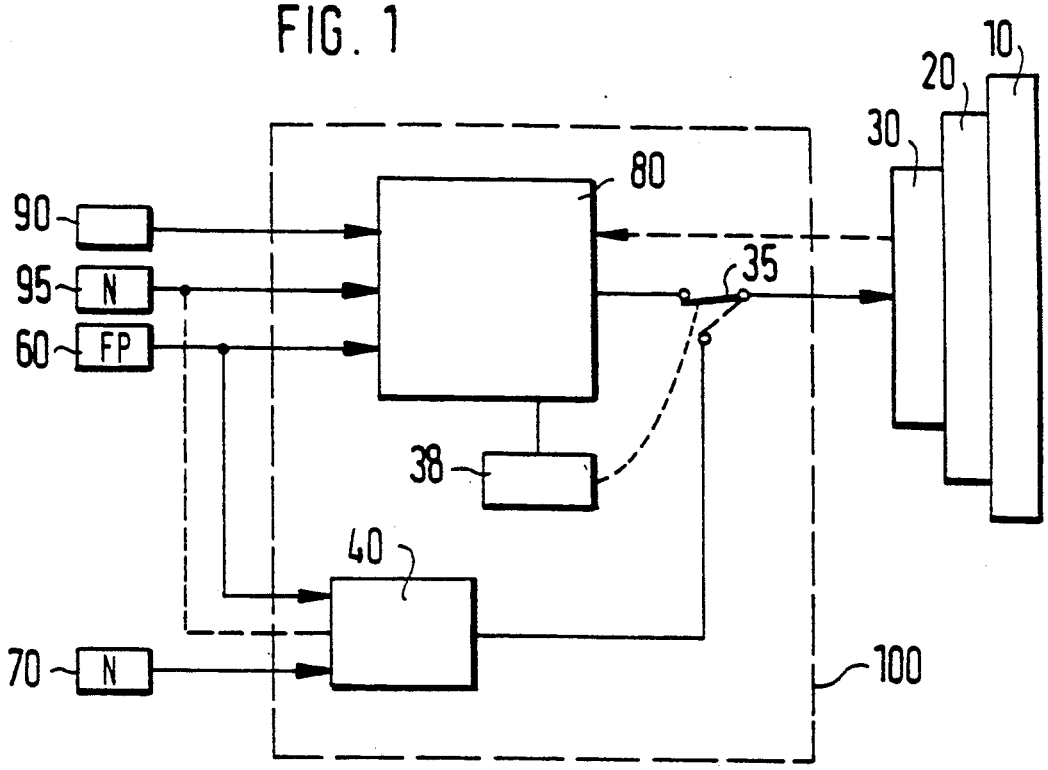
FIG. 1 shows a block diagram of the control system according to the present invention.

A block diagram of the control system according to the present invention is shown in FIG. 1. Fuel is metered by way of a fuel pump 20 into an internal combustion engine 10. A power-regulating controlling unit 30 thereby determines the fuel quantity to be injected. The controlling unit 30 is alternatively connected via a circuit component 35 (also described as a switch) either to a controlling device 80 or to an emergency controlling device 40. The controlling device 80 receives various input signals from various sensors 90, from a sensor 95 for emitting a speed signal, as well as from a gas-pedal position sensor 60. Furthermore, the possibility exists that a signal characterizing the position of the controlling unit 30 is fed to the controlling device 80. The design and method of functioning of a similar system is described, for example, in German Published Patent Application No. 26 50 247, corresponding to U.S. Pat. No. 4,223,654.

In addition, the gas-pedal position sensor 60 is connected to the emergency controlling device 40. A sensor 70 generates a signal which corresponds to the speed of the internal combustion engine. This signal is fed to the emergency controlling device 40. In the simplest case, this sensor 70 is located at a generator, which is also described as a dynamo. For this purpose, a signal corresponding to the rotational speed is measured at a terminal W of the generator.

The switch 35 is triggered by a monitoring device 38. This monitoring device is connected to the controlling device 80. The controlling device 80, the emergency controlling device 40, the monitoring device 38, and the switch 35 can be incorporated very advantageously in one control unit 100. Individual areas of the control unit are directed to the various functions.

The terminal W refers to a terminal connection to one of the phases of the three-phase current. The terminal W supplies a pulsating dc current, the frequency of which is proportional to the rotational speed. A substitute speed signal is derived on the basis of the frequency.

The method of the functioning of this system will now be described. In normal operations, the switch 35 is situated in the position as drawn in FIG. 1. In this case, the controlling unit 30 receives appropriate trigger signals from the controlling device 80. As a general rule, the controlling device specifies an actuating signal in the form of an actuating current. It is also conceivable, however, that the controlling device emits an actuating signal in the form of a voltage signal. The amplitude of this signal is thereby a measure of the fuel quantity to be injected.

The controlling unit 30 may be a power-regulating controlling unit. In the case of a self-ignitible internal combustion engine, the adjusting rod, for example, may be actuated. In the case of an internal combustion engine with applied spark ignition, the throttle valve may be triggered.

The controlling unit assumes a specific position dependent upon the actuating signal. This position is synonymous with a preset fuel quantity. It is particularly advantageous to measure the actual position of the controlling unit, and to signal that position back to the controlling device 80. In this case, the position of the controlling unit can be regulated to a preset value by means of a controller.

The monitoring device 38 constantly checks the operativeness of the controlling device 80, as well as the operativeness of the remaining components. For this purpose, such monitoring devices exchange signals with the monitoring components. Defects are recognized on the basis of these signals. If a sensor fails, for example, the position sensor of the controlling unit or one of the sensors 90, and/or if a malfunctioning of the controlling device occurs, the monitoring device 38 moves the switch 35 into the position drawn in with a dotted line. Thus, the controlling device 80 is separated from the controlling unit. In this case, the emergency controlling device 40 assumes the function of triggering the controlling unit 30. The emergency controlling device 40 processes the output signal from the gas-pedal position sensor 60 and a speed signal. The output signal from the gas-pedal position sensor 60 can be described as a driver's choice signal, which indicates the choice of the driver.

It is particularly advantageous when a substitute speed sensor 70 is used in place of the speed sensor 95. This is particularly important when the speed sensor 95 is defective. To make available a substitute speed signal, the dynamo is preferably drawn upon. A signal which is proportional to the rotational speed can be measured at the dynamo. Thus, the dynamo 70 supplies a signal which characterizes the rotational speed of the internal combustion engine. Thus, only signals which do not require any additional sensors are processed. Since only very few elements, such as the gas-pedal sensor, the substitute speed sensor, and the controlling unit must be operative, an emergency driving operation is possible when all remaining components fail.

Other sensors, as well, can be used quite advantageously. An example of such a substitute speed sensor is the start-of-injection sensor. The appropriate sensor needs only to fulfill the condition of emitting a signal that is dependent on the rotational speed of the internal combustion engine.

On the basis of the speed signal, the emergency controlling device 40 calculates a substitute actuating signal for the controlling unit 30. In addition to the rotational speed, the gas-pedal position is also considered.

The emergency controlling device 40 preferably has an analog design. The advantage of such a design is that the emergency controlling device 40 is particularly fail-safe. The emergency controlling device 40 can be embodied as a small, separate control unit or as a part of the control unit 100. When integrated into the control unit 100, no additional lines or connecting terminals are needed.

Figure 2:
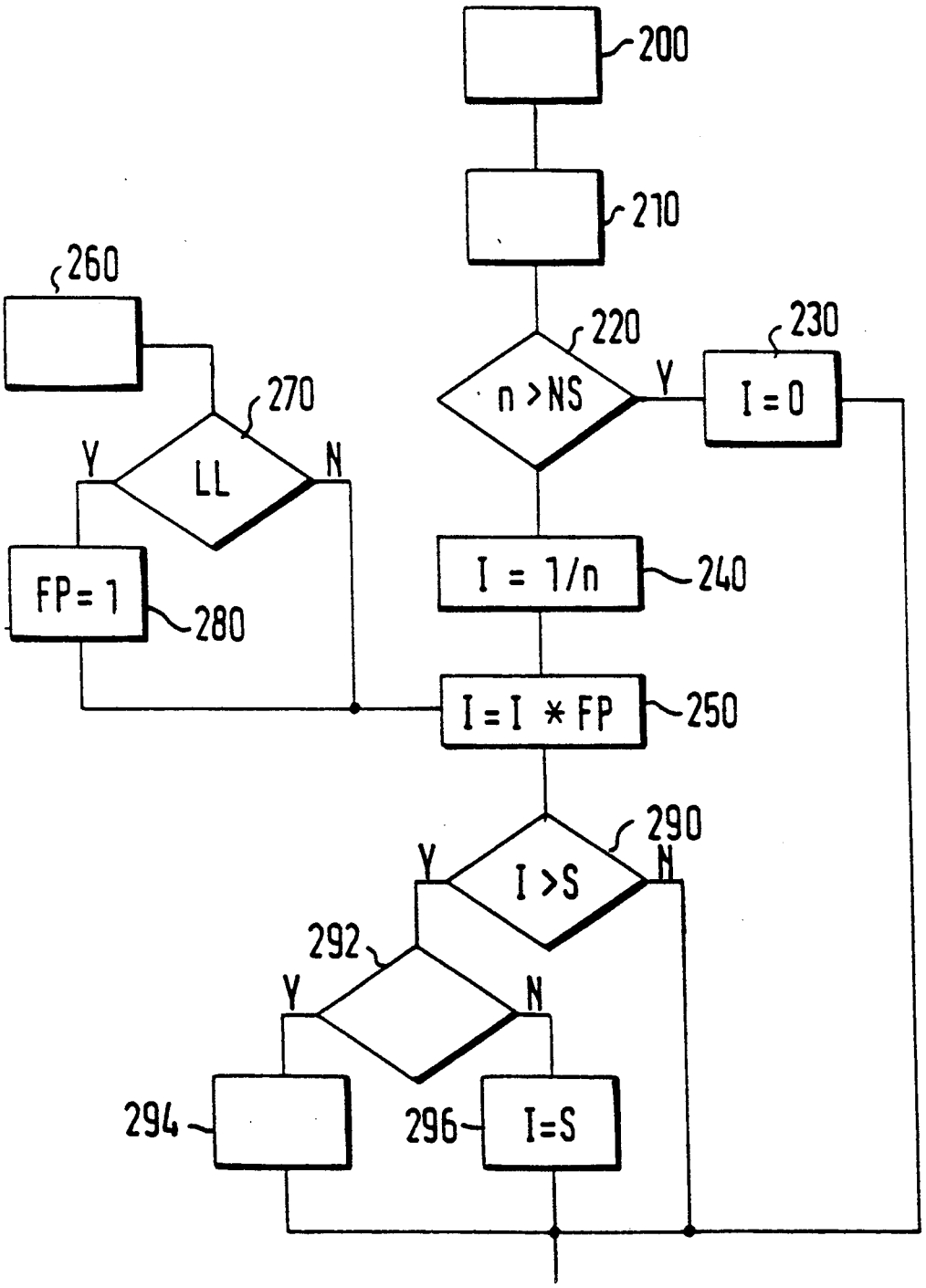
FIG. 2 shows a detailed flow chart to illustrate the method of the functioning of the system shown in FIG. 1.

Referring to FIG. 2, the method of the functioning of the control system according to the present invention will now be described through the use of a flow chart. In step 200, the control system is checked to determine whether an error exists. Such an error occurs when something in the controlling device 80 is not functioning and/or when a sensor is defective or supplies faulty signals. When this happens, the emergency electronics is activated, i.e., the switch 35 is shifted into the position drawn with a dotted line. The switch is triggered by the monitoring device 38. If the monitoring device 38 recognizes an error, it causes the switch-over.

Since the control system comprising the emergency controlling device 40 exhibits very good driving performance, one can accept the fact that the switch-over to emergency operation is made more often for the sake of safety. When the monitoring of the main control system indicates that the disturbance has passed, the switch is moved back to the controlling device 80. In step 210, a signal corresponding to the rotational speed is detected by a suitable sensor 70.

A final limitation of the rotational speed must be ensured using appropriate means. The final limitation prevents the rotational speed from exceeding a maximum speed. In the simplest case, this is achieved by stopping the actuating signal when a speed threshold is exceeded. To this end, in step 220, the control system is checked to determine whether the rotational speed is greater than a specified threshold NS. If this is the case, the actuating current I is set to zero in step 230. If this is not the case, the actuating current is set to the inverse value of the speed signal in step 240. Thus, the actuating signal is inversely proportional to the speed signal.

The position of the gas pedal is also considered in step 250. A signal FP proportional to the gas-pedal position is generated in step 260. In step 270, it is determined whether the internal combustion engine is in idle operation. If idle operation is determined, the gas-pedal signal FP is set to one in step 280, and step 250 follows. If idle operation is not determined, the system likewise continues with step 250. In the simplest case, the actuating current I for the controlling unit is multiplied by the gas-pedal position signal FP. However, it is also advantageous that various cumulative or multiplicative constants enter into the determination of the actuating current I.

In step 290, it is checked whether the actuating current I is greater than a specified maximum value S. If this is not the case, the controlling unit 30 receives this signal. If the actuating current is indeed greater than the specified maximum value, in step 292 it is checked whether a starter actuation is present. If this is the case, the actuating signal is set, in step 294, to a value required for the start-up. If this is not the case, the actuating signal is set to the maximum value S, in step 296. This means that the actuating signal is limited, outside of the start-up case, to a maximum permissible value S. The actuating current can be limited in a particularly simple manner by means of a current-limiting circuit arrangement in the controlling unit.

Since the mechanical full-load stop of the fuel pump is unchanged at the starting quantity, the current limitation during the starter actuation is canceled to enable a cold start when outside temperatures are low. This is performed in steps 292 and 294.

All that is required to implement the emergency controlling device 40 is a circuit arrangement that generates an actuating signal from the speed signal. This actuating signal is inversely proportional to the speed signal, whereby the position of the gas-pedal position sensor must be considered. The remaining steps can also be performed outside of the control unit by means of analog circuit arrangements and/or mechanical stop means.

Figure 3:
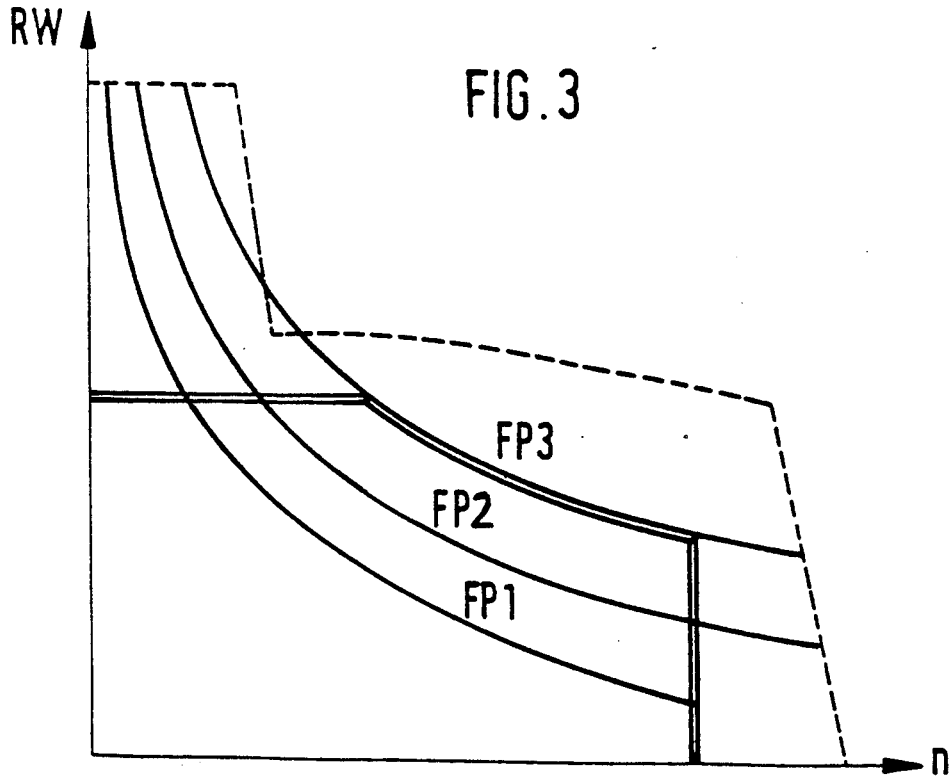
FIG. 3 shows a performance graph resulting from operation of a system according to the method illustrated in FIG. 2.

With this emergency controlling device 40 and the procedure described in FIG. 2, a performance graph essentially as depicted in FIG. 3 is attained. The performance graph, which is customary for diesel internal combustion engines, is drawn as a dotted line. For this purpose, the adjusting rod position RW is plotted as a function of the rotational speed n. The adjusting rod position is usually proportional to the actuating signal. Thus, the actuating current I can be plotted in place of the adjusting rod position.

The individual characteristic curves 1/n are drawn with single solid lines for various gas-pedal positions FP1, FP2 and FP3. A double solid line shows the permissible range of the controlling-unit current as a function of the rotational speed. This procedure makes it possible for the customary performance graph to be very closely approached. The bottom characteristic curve FP1 is used for the closed-loop control of the idle operation. This characteristic curve results when the gas pedal is not actuated.

What is claimed is:

1. A system for controlling an internal combustion engine, comprising:

first means for generating a first signal indicative of the state of a first measured parameter;

second means for generating a second signal indicative of the state of a second measured parameter; and a control unit for receiving the first and second signals and for supplying an actuating signal that is input to a controlling unit for controlling a predetermined function of the engine, the control unit further comprising a normal controlling device, an emergency controlling device, and a switch alternatively connectable to the normal or emergency controlling device, the normal and emergency controlling devices each being capable of generating the actuating signal based on the first and second signals, with the actuating signal further being based upon the second signal and being inversely proportional to the first signal.

2. The system as recited in claim 1, wherein the first signal is a speed signal indicative of the rotational speed of the engine.

3. The system as recited in claim 1, wherein the second signal is a signal indicative of a measured parameter associated with an operation of the engine.

4. The system as recited in claim 1, wherein the controlling unit is a power-regulating controlling unit.

5. The system as recited claim 4, wherein the controlling unit determines the quantity of fuel to be injected into the engine.

6. The system as recited in claim 1, wherein the first means includes a speed sensor.

7. The system as recited in claim 1, wherein the first means includes a substitute speed sensor.

8. The system as recited in claim 7, wherein the substitute speed sensor includes a generator.

9. The system as recited in claim 1, wherein the second means includes a gas-pedal position sensor.

10. The system as recited in claim 1, wherein the actuating signal is ceased when the first signal exceeds a predetermined threshold.

11. The system as recited in claim 1, wherein the control unit device includes analog components.

12. A system for controlling an internal combustion engine, comprising:

first means for generating a first signal indicative of the state of a first measured parameter;

second means for generating a second signal indicative of the state of a second measured parameter; and a control unit for receiving the first and second signals and for supplying an actuating signal that is input to a controlling unit for controlling a predetermined function of the engine, the control unit including a normal controlling device, an emergency controlling device, and a switch alternatively connectable to the normal or emergency controlling device, the normal and emergency controlling devices each being capable of generating the actuating signal based on the first and second signals, with the actuating signal further being based upon the second signal and being inversely proportional to the first signal, the control unit further including a current-limiting circuit for limiting the actuating signal to a predetermined maximum value.

13. The system as recited in claim 12, wherein the actuating signal is limited except at engine start-up.

14. A system for controlling fuel injection of an internal combustion engine of a vehicle under normal and emergency operating conditions, comprising:

a speed sensor for measuring a rotational speed of the engine and for generating a first signal based thereon;

a gas-pedal position sensor for measuring a position of a gas pedal of the vehicle and for generating a second signal based thereon; and a control unit for receiving the first and second signals and generating an actuating signal useful for controlling fuel injection for the engine, the control unit including a normal controlling device, an emergency controlling device, and a switching means that is alternatively connectable to the normal controlling unit and the emergency controlling device for supplying the actuating signal to an injection control means, the actuating signal being based upon the second signal and being inversely proportional to the first signal.

15. The system according to claim 14, wherein the control unit further includes a monitoring device for controlling the switching means.

* * * * *